US007262697B2

(12) United States Patent
Meng et al.

(10) Patent No.: US 7,262,697 B2
(45) Date of Patent: Aug. 28, 2007

(54) DUAL SENSING INTRUSION DETECTION METHOD AND SYSTEM WITH STATE-LEVEL FUSION

(75) Inventors: Lingmin Meng, Rolling Meadows, IL (US); William S. DiPoala, Fairport, NY (US); Wolfgang M. Grimm, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 11/031,395

(22) Filed: Jan. 7, 2005

(65) Prior Publication Data

US 2006/0164233 A1 Jul. 27, 2006

(51) Int. Cl.
*G08B 13/00* (2006.01)

(52) U.S. Cl. ..... 340/541; 340/522; 340/567

(58) Field of Classification Search ..... 340/541, 340/522, 552, 567
See application file for complete search history.

(56) References Cited

U.S. PATENT DOCUMENTS 5,331,308 A * 7/1994 Buccola et al. ..... 340/522
5,491,467 A * 2/1996 Tracy et al. ..... 340/522
5,578,988 A 11/1996 Hoseit et al.
6,246,321 B1 * 6/2001 Rechsteiner et al. ..... 340/522
6,288,395 B1 * 9/2001 Kuhnly et al. ..... 340/567
6,351,234 B1 2/2002 Choy
7,034,675 B2 * 4/2006 DiPoala et al. ..... 340/522

FOREIGN PATENT DOCUMENTS

EP 0 581 569 A 2/1994

OTHER PUBLICATIONS

International Search Report for PCT/US06/000263, Date of Mailing Jun. 29, 2006.

* cited by examiner

*Primary Examiner*—John Tweel, Jr.
(74) *Attorney, Agent, or Firm*—Kenyon & Kenyon LLP

(57) ABSTRACT

A system and method for intrusion detection includes a first sensor for detecting an intrusion within an area and for outputting a first signal, a second sensor for detecting an intrusion within the area, the second sensor outputting a second signal, and a processor to receive both the first and second signals and to classify both the first and second signals as having a particular state. The processor provides an output for generating an alarm signal when the first signal and the second signal are classified with corresponding states.

20 Claims, 4 Drawing Sheets

DUAL SENSING INTRUSION DETECTION METHOD AND SYSTEM WITH STATE-LEVEL FUSION

FIELD OF THE INVENTION

The present application relates to intrusion detection, and more particularly relates to a system and method for intrusion detection in which the output of at least two different types of radiation detectors are processed using state-level fusion.

BACKGROUND INFORMATION

It is believed that certain dual-sensing intrusion detection systems, which simultaneously employ two different detection techniques may monitor a volume of space using a passive infrared sensor (PR) and a microwave detector adapted to determine a Doppler frequency shift in received radiation. The redundancy provided by the two distinct detection devices is intended to eliminate the occurrence of false alarms for certain "non-intrusion" events. For example, a spinning fan may give rise to a strong Doppler signal but may not generate significant amounts of IR radiation. In such systems, it may be advantageous to generate an alarm signal when both detection devices detect an intrusion during the same period. According to this technique, an alarm is generated by combining the output of the detection devices by an "AND" logic gate. Since the output signals from each of the detection devices is processed separately from the other and they are only combined at a final stage to reach a determination as to the presence of an intruder, this technique may be referred to as "decision-level fusion".

The respective detection devices may have varying sensitivities with respect to different intrusion events. For example, Doppler microwave sensors may be more sensitive to radial movement while IR sensors may be more sensitive to transverse movements across a scanned area. Continual adjustment of the relevant thresholds for detection may be required for optimal performance. It is believed that a difficulty associated with this variation is in finding an optimal balance between providing sufficient sensitivity to enable detection of intrusions in most situations and avoiding false alarms.

One situation that may particularly test this balance is the movement of pets in the vicinity of the detection system. The movement of a large dog, for example, can induce and/or generate high-amplitude signals at both IR and microwave detection devices. It is believed that U.S. Pat. No. 5,670,934 is directed to this problem by allocating upper and lower IR focus zones (taking advantage of the fact that pets are normally shorter than people) and by temperature compensation to correct for the influence of ambient conditions. However, even with temperature compensation, it may be difficult to set the intrusion detection threshold for the IR signal because the IR focus zones are not necessarily perfectly positioned and do not completely differentiate between larger and smaller moving objects. In particular, when a person moves in a radial towards or away from a detector, the detected IR signals may be smaller than those generated by pets, which may result in a false positive output. The use of shields, such as umbrellas that block IR radiation can compound the problem, since the IR allocated to the "upper zone" may not receive a sufficient amount of radiation to detect the presence of an intruder in this case.

Regarding the processing of signals output by the detection devices, it is believed that U.S. Pat. No. 5,109,216 refers to adjusting the gain of an amplifier for processing the output of one detection channel. In addition, U.S. Pat. No. 5,578,988 refers to adjusting a microwave detection threshold based upon detection from another channel due to dynamic changes in the environment. However, it is also believed that the adjustment of amplitude described in these references may be insufficient to distinguish human intruders from pets.

SUMMARY OF THE INVENTION

An exemplary system for intrusion detection according to the present invention includes a first sensor for detecting an intrusion within an area which outputs a first signal, a second sensor for detecting an intrusion within the area which outputs a second signal, and a processor to receive both the first and second signals and to classify both the first and second signals as having a particular state, in which the processor provides output for the generation of an alarm signal when the first signal and the second signal are classified with corresponding states.

In a further exemplary embodiment, the first sensor is a passive infrared (PIR) sensor, and the second sensor is a microwave detector. According to a particular implementation, the first and second signals are classified as having one of at least three distinct states and according to a further implementation, and the processor includes one output corresponding to each state of each of the PIR and microwave sensors.

In yet another embodiment, the system may include at least three AND gates, each of which receive one output from the processor associated with a particular state of the PIR sensor signal and another output from the processor associated with the corresponding state of the microwave sensor signal, an OR gate which receives outputs from each of the at least three AND gates, and an alarm, the alarm receiving output from the OR gate such that the alarm is activated when corresponding states of the PIR sensor signal and the microwave sensor signal coexist.

In still further exemplary embodiments, the at least three states include three states designated A, B, and C. The PIR State A may be designated to occur when any one of three conditions (i), (ii) and (iii), are satisfied, PIR State B may be designated to occur when a specified number of significant alternating extremes of the IR signal occur within a predefined period of time, and/or PIR State C may be designated to occur when PIR State B and a single occurrence of condition (i) of PIR State A occurs within a specified time window limit.

According to further exemplary embodiments of the system, microwave State A may be designated to occur when the microwave signal includes three pulses which exceed an upper threshold within a predefined period of time, microwave State B may be said to occur when a certain number of alternating extremes of the microwave signal have been counted, and/or microwave State C occurs when the microwave signal exceeds a regular upper threshold by a specified amount.

An exemplary method of intrusion detection using state-level fusion of dual sensors according to the invention includes classifying the signal output of each of the dual sensors into a number of states, generating a dual output corresponding to the states of the dual sensors, and fusing the dual output such that an alarm is generated when the dual sensors are simultaneously in corresponding states.

According to a particular exemplary embodiment, the dual sensors include a PIR sensor and a microwave sensor.

According to another exemplary embodiment, the signal output of the dual sensors is classified into three states A, B and C. PIR State A may be designated to occur when any one of three conditions (i), (ii) and (iii), are satisfied, PIR State B may be designated to occur when a specified number of significant alternating extremes of the IR signal occur within a predefined period of time, and/or PIR State C may be designated to occur when PIR State B and a single occurrence of condition (i) of PIR State A occurs within a specified time window limit.

According to another exemplary embodiment, microwave State A may be designated to occur when the microwave signal includes three pulses which exceed an upper threshold within a predefined period of time, microwave State B may be designated to occur when a certain number of alternating extremes of the microwave signal have been counted, and/or microwave State C may be designated to occur when the microwave signal exceeds the upper threshold by a specified amount.

According to still another exemplary embodiment, the effects of ambient temperature conditions may be compensated for.

In a particular implementation, significant alternating extremes, as used in determininng PIR State B, are ascertained when polarities of adjacent extremes of a signal are opposite, any signal sampled between the adjacent extremes has a value between the values of the adjacent extremes, and a difference in value between any two adjacent extremes exceeds a predefined threshold.

DETAILED DESCRIPTION

The exemplary embodiment and/or exemplary method of the present invention provides a system and/or method for intrusion detection using dual sensors in which signal states of the dual sensors are paired or "fused". Conditions for establishing intrusion occur where the dual sensors are classified into corresponding states, i.e., the output of a first sensor qualifies it for state 'A', while the output of a second sensor qualifies it for a corresponding state 'A'. Since there are several states, e.g., A, B, C, etc., there can accordingly be several state-level corresponding pairings between the outputs of the dual sensors (A—A, B—B, C—C, etc.). Since any occurrence of a state-level correspondence can indicate the presence of an intrusion event, state-level fusion is performed prior to the decision-level, which flexibly enables different detection states to result in the detection of an intrusion event.

According to an embodiment of the present invention, the first sensor is a passive infrared (PIR) sensor and the second sensor is a microwave Doppler sensor. The following section describes exemplary detected states of the IR and microwave sensors designated as states A, B and C. A "detected state" may be defined herein as a combination of one or more detected signal conditions occurring during a monitored period.

I. Sensor States:

A. PIR Sensor States

PIR State A

Figure 1:
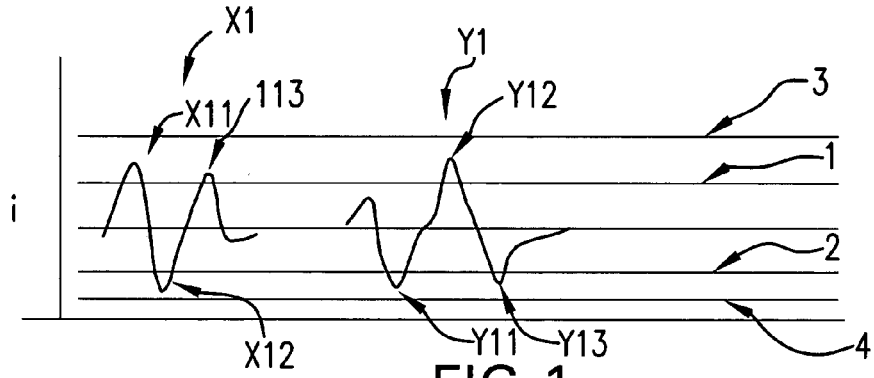
FIG. 1 shows a graph of an exemplary PIR sensor signal versus time, illustrating examples of condition (i) of PIR State A.

According to an exemplary embodiment of the present invention, a PIR sensor may be identified as in state A when any one of the following three conditions (i), (ii) or (iii) are detected:

For condition (i), three alternating signal pulses exceed predefined upper or lower thresholds within a predefined time period. It is noted at the outset that the predefined time period reflected may be set in accordance with the knowledge and experience of the skilled practitioner for appropriate signal detection and characterization. FIG. 1, which shows an exemplary graph of amplitude of a PIR sensor over time, illustrates this condition. As shown, the graph identifies five exemplary signal levels 1 to 4, in which 1 constitutes a 'regular' upper threshold and 2 constitutes a 'regular' lower threshold. The regular thresholds 1, 2 are compensated for the effects of ambient temperature. A first signal X1 includes a first upward pulse X11 in which the amplitude of the signal exceeds upper threshold 1, a downward pulse X12 in which the amplitude falls below the lower threshold 2, and a second upward pulse X13 in which the amplitude again surpasses the upper threshold 1. Thus, the signal represented by curve X1 fulfills the conditions for state A in that three alternating pulses X11, X12, and X13 each exceed the relevant thresholds within a predefined period of time. Similarly, the signal represented by curve Y1 also fulfills condition (i) of state A in that a first downward pulse Y11 goes below the lower threshold 2, the second upward pulse Y12 surpasses the upper threshold 1 and the next downward pulse Y13 falls below lower threshold 2.

Figure 2:
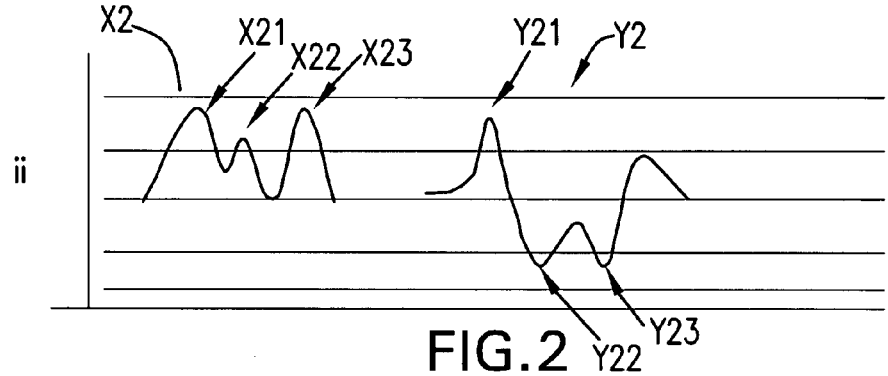
FIG. 2 shows a graph of another exemplary PIR sensor signal versus time, illustrating examples of condition (ii) of PIR State A.

For condition (ii), any three pulses exceed (or fall below) the regular thresholds within a predefined period of time. FIG. 2, which also shows an exemplary graph of amplitude of a PIR sensor over time, illustrates this condition. A first signal X2 includes three consecutive pulses X21, X22, and X33 which each surpass the upper threshold 1. Similarly a second signal Y2 includes a first pulse that exceeds the upper threshold 1 followed by two pulses which both fall below the lower threshold 2. Both signals X2 and Y2 fulfill condition (ii) in that each signal includes three pulses which exceed or fall below the relevant thresholds within a predefined time period.

Figure 3:
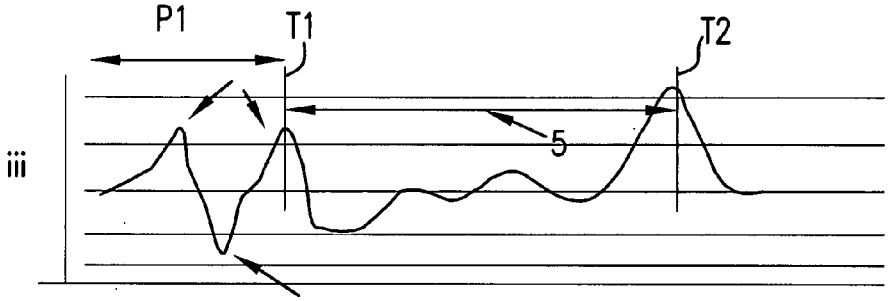
FIG. 3 shows a graph of a further exemplary PIR sensor signal versus time, illustrating examples of condition (iii) of PIR State A.

For condition (iii), a high-amplitude pulse exceeds an extreme threshold set above or below the regular threshold 1, 2 within one minute after the latest occurrence of condition (i) or (ii). FIG. 3 illustrates this condition. As shown, an unbroken signal includes a portion P1 in which condition (i) is satisfied. In the one-minute interval 5 starting with the fulfillment of condition (i) at T1 and ending at T2, the signal exceeds an extreme threshold 3, thus fulfilling condition (iii).

PIR State B

Figure 6:
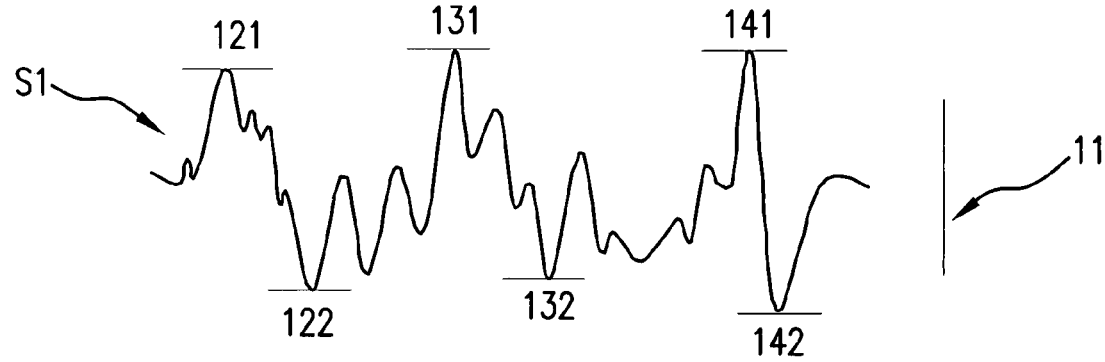
FIG. 6 shows a graph of an exemplary PIR sensor signal versus time, illustrating examples of significant alternating extremes for establishing PIR State B.
Figure 6:
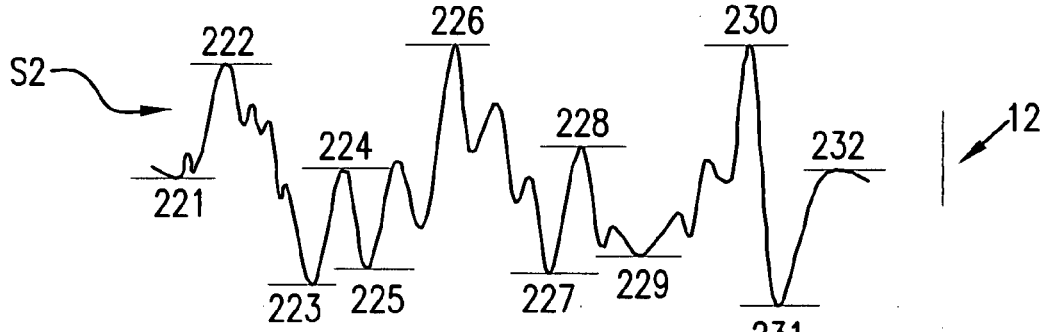

According to an exemplary embodiment of the present invention, a PR sensor may be identified as in state B when a PIR signal has four "significant alternating extremes" within a predefined time period. "Significant alternating extremes" is defined as occurring when adjacent extremes are opposite in polarity, any signal that is sampled between the two extremes has a value in between the values of the adjacent extremes, and the difference between any two adjacent extremes exceeds a predefined threshold which is substantially smaller than the offset of the regular threshold used in condition (i) of PR state as described above. In a particular implementation, the threshold for adjacent extremes may be set to approximately one-quarter the value of the regular offset. FIG. 6 illustrates two exemplary identical signals S1 and S2 for which different predefined thresholds 11, 12 are set. As can be discerned, the threshold 11, 12 determines which pulses are identified as having significant alternating extremes. With respect to signal S1, the threshold 11 has a relatively high value so that levels 121,122, 131,132, 141,142 represent significant alternating extremes. With respect to signal S2, a relatively lower threshold 12 is set, and there are numerous significant alternating extremes 221, 222, 223, 224, 225, 226, 227, 228, 229, 230, 231, 232 which exceed this threshold.

Figure 7:
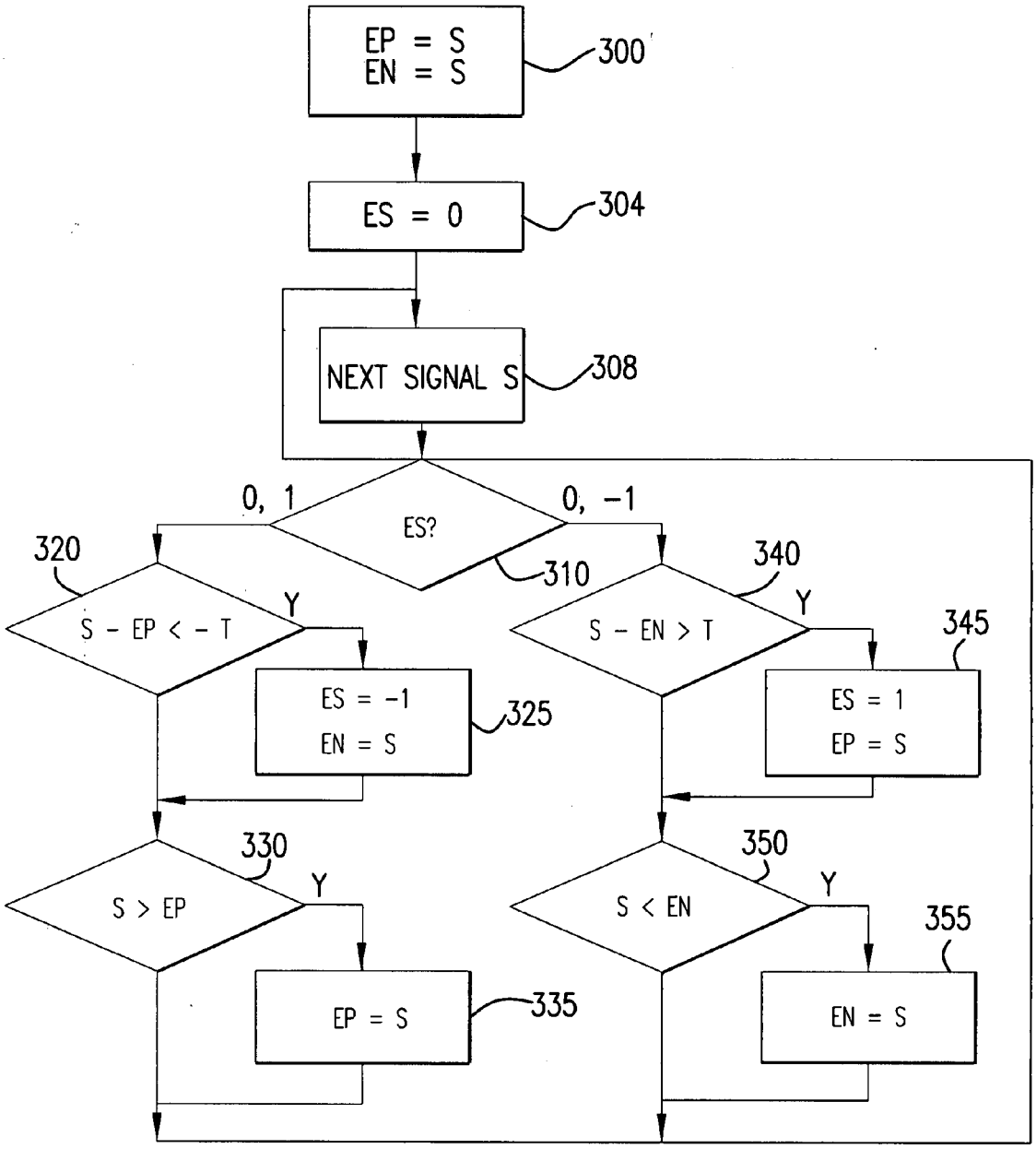
FIG. 7 is a flow chart of an exemplary method for ascertaining significant alternating extremes for PIR State B.

FIG. 7 is a flow chart of an exemplary method for determining significant alternating extremes, where the symbol S represents a sampled level of a signal S, ES represents the sign or polarity (high or low) of the last extreme, EP is the value of the last positive extreme, and EN is the value of the last negative extreme. In an initialization step 300, both EP and EN are given the value of S, and in step 304, the polarity of the first extreme is set to 0, signifying that there is, as of yet, no extreme value. In step 308, the next signal pulse is sampled, and at step 310, the polarity of the pulse is determined. If the pulse is positive, the method cycles to step 320, in which it is determined whether the difference between value of the pulse and the last extreme positive is less than the relevant threshold times minus one. If the difference is less, in step 325, the sign of the signal is assigned a negative polarity and the "last extreme negative" value is assigned the current value of the signal before performing step 330. If the difference is greater, step 330 is performed directly, and a determination is made as to whether the signal value is larger than the last positive extreme, if it is, in step 335, the last positive extreme is assigned the value of the signal. After step 335, and after step 330 if the signal is not greater than the last positive extreme, the method cycles back to step 300. If in step 310, the signal is originally determined to have negative polarity, a determination is made, in step 340, as to whether the difference between value of the pulse and the last extreme negative is less than the relevant threshold. If it is, in step 345, the sign of the signal is assigned a positive polarity and the last extreme positive is assigned the value of the current signal. If it is not, and also if step 345 has already been performed, it is determined in step 350 whether the value of the signal is less than the last extreme negative. If it is, in step 355, the value of the last extreme negative is assigned the value of the current signal. If in step 350, the value of the signal is not less than the last extreme negative, and also after step 355 is performed, the method cycles back to step 300. In the initial run, when the polarity is set to zero, the method cycles to both step 320 and step 340 (and their respective ensuing steps).

PIR State C

According to an exemplary embodiment of the present invention, a PIR sensor may be identified as in State C if State B and a single occurrence of State A occur within a certain time window limit, which lasts for a certain amount of time. This state may occur when a person moves quickly in a radial direction close to the PIR sensor. When the movement is toward the sensor, the regular pulse usually follows the State B condition, and when the movement is away from the sensor, the regular pulse usually precedes the State B condition.

B. Microwave Sensor States

Microwave State A

Figure 5:
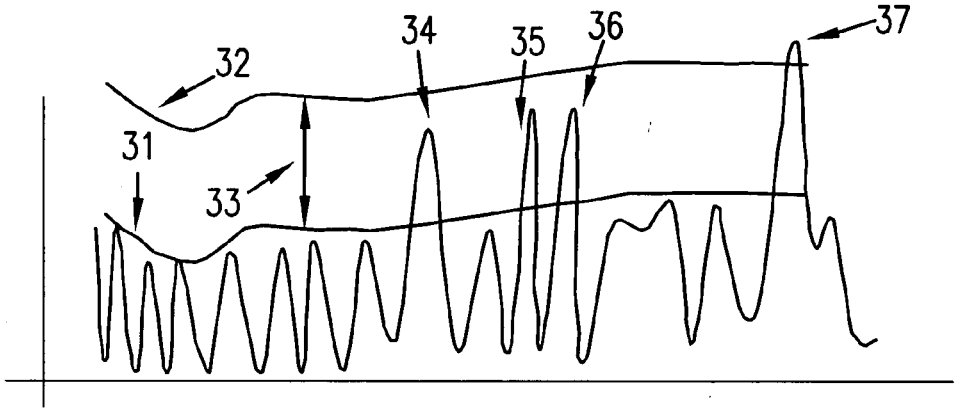
FIG. 5 shows a graph of another exemplary microwave sensor signal versus time, illustrating examples of conditions for establishing microwave State A and microwave State C.

According to an exemplary embodiment of the present invention, a microwave sensor may be identified as in state A when three pulses that exceed an upper threshold occur within a predefined time period. FIG. 5 illustrates an exemplary microwave sensor signal. As shown, pulses 34, 35 and 36 exceed predefined upper threshold 31.

Microwave State B

Figure 4:
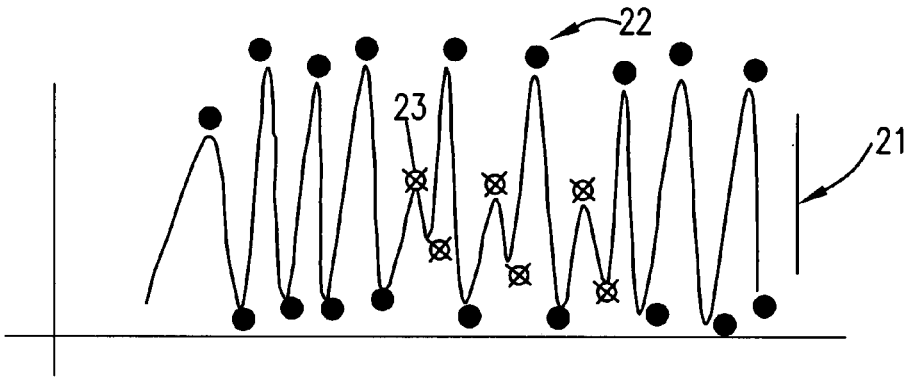
FIG. 4 shows a graph of an exemplary microwave sensor signal versus time, illustrating examples of alternating extreme conditions for establishing microwave State B.

According to an exemplary embodiment of the present invention, a microwave sensor may be identified as in state B when a certain number of alternating extremes are counted in a manner analogous to (but slightly different from) the "significant alternating extremes" technique discussed with respect to PIR State B. In this case, an alternating extreme qualifies when the polarities of adjacent extremes are opposite and any signal sampled between the adjacent extremes has a value in between the values of the adjacent extremes. FIG. 4 shows an exemplary microwave signal in which both circles and circles with the crosses identify the alternating extremes. A counter monitors the difference between adjacent extremes. Once a new extreme is ascertained, the difference between the current extreme and the previous extreme is calculated. If the difference is larger than a predefined threshold 21, the counter increases by 1, indicated by the circles in FIG. 4. Otherwise, if the difference is smaller than a predefined threshold, then the counter is decreased by two, which is indicated by the circles with the crosses in FIG. 4. Once a counter reaches a predefined value, such as 15, the conditions for microwave State B are satisfied. This state lasts for a predefined period of time.

Microwave State C

According to an exemplary embodiment of the present invention, a microwave sensor may be identified as in state C when a "large pulse" is defined. A large pulse qualifies if it surpasses the upper threshold used in State A by a predefined amount. As illustrated in FIG. 5, a large pulse 37 is shown which exceeds the upper threshold 31 by the predefined amount 33. During microwave State A, any large pulse simultaneously qualifies the signal for State C.

II. State-Level Fusion

According to an exemplary embodiment of the present invention, an intrusion alarm is initiated when any of the following occurs: i) PIR State A and Microwave State A coexist during a time interval; ii) PIR State B and Microwave State B coexist during a time interval; and iii) PIR State C coexists with Microwave State C.

Figure 8:
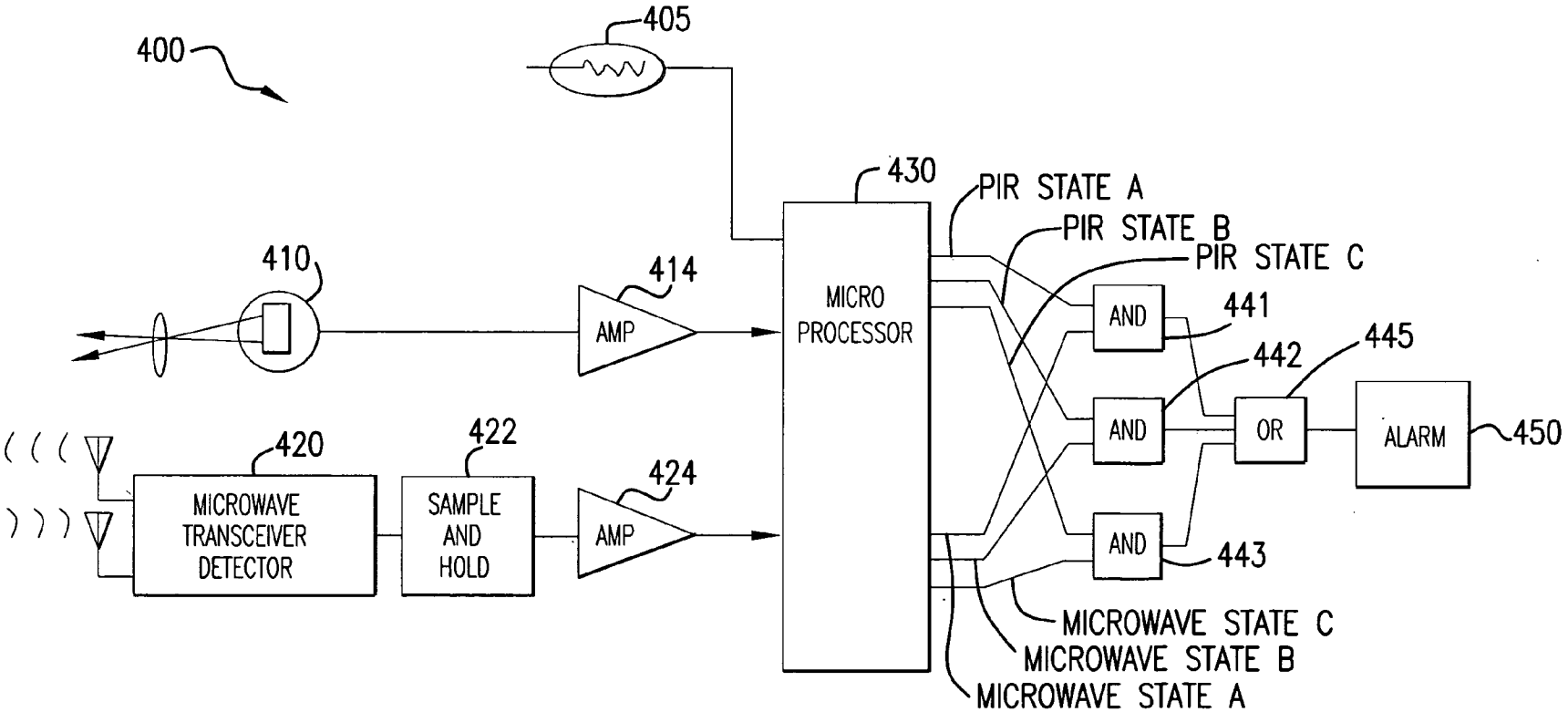
FIG. 8 is a block diagram of an exemplary embodiment of a system for intrusion detection using state-level fusion of outputs from dual sensors.

FIG. 8 shows an embodiment of a system for implementing the state-level fusion method according to the present invention. The system 400 includes a PIR sensor 410 and a microwave transceiver detector 420, which each output detection signals via respective amplifiers 414, 424 to a microprocessor 430 (before input to the amplifier, the microwave sensor output may be first processed in a sampling circuit 422 to determine a Doppler shift). At the microprocessor 430, the signals derived from the PIR sensor 410 and the microwave sensor 420 are processed to determine whether the signals correspond to any of the states A, B, C that are monitored. The microprocessor 430 also compensates for the effects of ambient temperature by receiving a temperature measurement from thermometer 405.

The microprocessor 430 includes an output corresponding to each state of the various sensors, i.e., there are PIR State A, PIR State B, PIR State C and microwave State A, microwave State B and microwave State C outputs. The output may be a digital signal where a HIGH level indicates that the corresponding state is occurring. The outputs are coupled via AND gates 441, 442, 443 so that PIR State A is AND-gated with microwave State A, PIR State B is AND-gated with microwave State B, and PIR State C is AND-gated with microwave State C. The AND gates will output HIGH only when the corresponding states of both of the corresponding outputs from the microprocessor are high, i.e., the corresponding states at both sensors overlap. The outputs of each of the AND-gates 441, 442, and 443 are coupled to an OR gate 445, which, in turn outputs a HIGH signal when any of the AND gates 441, 442, and 443 outputs HIGH. The output of the OR gate 445 is fed to an alarm 450. In other words, the OR gate 445 outputs HIGH, and an alarm is activated, when the State at one of the sensors overlaps with the corresponding state at the other sensor. The state-level fusion provided by system 400 provides adaptability and helps fine tune the balance between intrusion detection and false alarms because it allows various detection states to be defined with more subtlety and with a greater degree of precision.

What is claimed is:

1. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify simultaneously both the first and second signals as having a particular state, wherein the particular state is a varying condition of the signal during a predefined period;

wherein the processor provides an output for generating an alarm signal when the first signal and the second signal are classified simultaneously with corresponding states that match the particular varying condition.

2. The system of claim 1, wherein the first sensor is a passive infrared (PIR) sensor, and the second sensor is a microwave detector.

3. The system of claim 1, wherein the first and second signals are classified as having one of at least three distinct states.

4. The system of claim 2, wherein the processor includes one output corresponding to each state of each of the PIR and microwave sensors.

5. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the first and second signals are classified as having one of at least three distinct states, and wherein the processor includes one output corresponding to each state of each of the PIR and microwave sensors, the system further comprising:

at least three AND gates, each of which is for receiving one output from the processor associated with a particular state of the PIR sensor signal, and also receiving another output from the processor associated with the corresponding state of the microwave sensor signal;

an OR gate for receiving outputs from each of the at least three AND gates; and an alarm for receiving an output from the OR gate, such that the alarm is activated when the corresponding states of the PIR sensor signal and the microwave sensor signal coexist.

6. The system of claim 3, wherein the at least three states include three states A, B, and C.

7. The system of claim 6, wherein a PIR State A occurs when at least one of a first condition (i), a second condition (ii), and a third condition (iii) are satisfied, wherein (i) is a specified number of alternating signal pulses exceeding an upper threshold or falling below a lower threshold within a predefined time period, (ii) is a specified number of signal pulses exceeding the upper threshold or falling below the lower threshold with the predefined period of time and (iii) is a high-amplitude signal pulse exceeding an upper extreme threshold set above the upper threshold or falling below a lower extreme threshold set below the lower threshold.

8. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the at least three states include three states A, B, and C, and wherein PIR State B occurs when a specified number of significant alternating extremes of the IR signal occur within a predefined period of time.

9. The system of claim 8, wherein the specified number is four occurrences.

10. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the at least three states include three states A, B, and C, and wherein PIR State C occurs when PIR State B and a single occurrence of a first condition of a PIR State A occurs within a specified time window limit.

11. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the at least three states include three states A, B, and C, and wherein a microwave State A occurs when the microwave signal includes three pulses which exceed an upper threshold occur within a predefined period of time.

12. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the at least three states include three states A, B, and C, and wherein a microwave State B occurs when a certain number of alternating extremes of the microwave signal have been counted.

13. A system for intrusion detection, comprising:

a first sensor for detecting an intrusion within an area and for outputting a first signal;

a second sensor for detecting an intrusion within the area, the second sensor outputting a second signal; and a processor to receive both the first and second signals and to classify both the first and second signals as having a particular state;

wherein the processor provides an output for generating an alarm signal when the first signal and the second signal are classified with corresponding states, wherein the at least three states include three states A, B, and C, and wherein a microwave State C occurs when the microwave signal exceeds a regular upper threshold by a specified amount.

14. A method of intrusion detection using state-level fusion of dual sensors, the method comprising:

classifying simultaneously a signal output of each of the dual sensors into a number of states, each state being a particular varying condition of the signal during a predefined period of time;

generating a dual output corresponding to the states of the dual sensors;

fusing the dual output; and generating an alarm when the dual sensors are simultaneously in corresponding states that match the particular varying condition of the signal.

15. The method of claim 14, wherein the dual sensors include a PIR sensor and a microwave sensor.

16. The method of claim 15, wherein signal output of the dual sensors is classified into three states A, B and C.

17. A method of intrusion detection using state-level fusion of dual sensors, the method comprising:

classifying a signal output of each of the dual sensors into a number of states;

generating a dual output corresponding to the states of the dual sensors;

fusing the dual output; and generating an alarm when the dual sensors are simultaneously in corresponding states, wherein the dual sensors include a PIR sensor and a microwave sensor, wherein signal output of the dual sensors is classified into three states A, B and C, and wherein;

a PIR State A occurs when any one of a first condition, a second condition and a third condition is satisfied;

a PIR State B occurs when a specified number of significant alternating extremes of the IR signal occur within a predefined period of time; and a PIR State C occurs when the PIR State B and a single occurrence of condition (i) of PIR State A occurs within a specified time window limit.

18. A method of intrusion detection using state-level fusion of dual sensors, the method comprising:

classifying a signal output of each of the dual sensors into a number of states;

generating a dual output corresponding to the states of the dual sensors;

fusing the dual output; and generating an alarm when the dual sensors are simultaneously in corresponding states, wherein the dual sensors include a PIR sensor and a microwave sensor, wherein signal output of the dual sensors is classified into three states A, B and C, and wherein:

a microwave State A occurs when the microwave signal includes three pulses which exceed an upper threshold occur within a predefined period of time;

a microwave State B occurs when a certain number of alternating extremes of the microwave signal have been counted; and a microwave State C occurs when the microwave signal exceeds the upper threshold by a specified amount.

19. The method of claim 14, further comprising:

compensating for an effect of an ambient temperature condition.

20. The method of claim 17, wherein significant alternating extremes are determined when polarities of adjacent extremes of a signal are opposite, any signal sampled between the adjacent extremes has a value between the values of the adjacent extremes, and a difference in value between any two adjacent extremes exceeds a predefined threshold.

* * * * *